US008973170B2

(12) United States Patent
Cominsky

(10) Patent No.: US 8,973,170 B2
(45) Date of Patent: Mar. 10, 2015

(54) TRANSPORT HOOD INCLUDING SKIRT

(71) Applicant: John C. Cominsky, Clover, SC (US)

(72) Inventor: John C. Cominsky, Clover, SC (US)

( * ) Notice: Subject to any disclaimer, the term of this patent is extended or adjusted under 35 U.S.C. 154(b) by 0 days.

(21) Appl. No.: 13/774,965

(22) Filed: Feb. 22, 2013

(65) Prior Publication Data

US 2014/0237705 A1 Aug. 28, 2014

(51) Int. Cl.

| | |
|---|---|
| ***A42B 1/06*** | (2006.01) |
| ***A41B 9/04*** | (2006.01) |
| ***A41D 13/00*** | (2006.01) |
| ***A42B 1/04*** | (2006.01) |
| ***A41D 13/11*** | (2006.01) |

(52) U.S. Cl.

CPC ..... *A41D 13/1153* (2013.01); *A42B 1/04* (2013.01); *A41D 13/1161* (2013.01); *A41D 2200/20* (2013.01)

USPC ..... 2/410; 2/206; 2/9; 2/202; 2/205; 128/857

(58) Field of Classification Search

CPC ..... A41D 13/00; A42B 1/04; A42B 1/00; A42B 3/003; A42B 3/18

USPC ..... 2/410, 202, 203, 206, 174, 171.2, 2/181.2, 181.6, 175.5–6; 128/857, 128/857.973, 201.24–25, 201.22, 206.24, 128/206.27

See application file for complete search history.

(56) References Cited

U.S. PATENT DOCUMENTS

| | | | | |
|---|---|---|---|---|
| 128,451 | A | | 7/1872 | Ackerman |
| 806,099 | A | | 12/1905 | Boehm |
| 1,186,703 | A | | 6/1916 | Sullivan |
| 1,504,100 | A | | 8/1924 | Danubio |
| 1,678,649 | A | | 7/1928 | Renault |
| 1,800,051 | A | * | 4/1931 | Blanco ..... 2/206 |
| 2,184,240 | A | | 12/1939 | McInnis |
| 2,191,589 | A | | 2/1940 | Sacks |
| 2,355,283 | A | | 8/1944 | Diss |
| 2,446,122 | A | | 7/1948 | Bills |
| 2,477,437 | A | | 7/1949 | Borowick |
| 2,869,132 | A | | 1/1959 | Drummond |
| 3,084,446 | A | | 4/1963 | Freedman et al. |
| 3,241,155 | A | | 3/1966 | Phillips |
| 3,582,989 | A | | 6/1971 | Fassbender |
| 3,789,839 | A | | 2/1974 | Lund et al. |
| 4,173,042 | A | | 11/1979 | Krzewinski-Morris |
| 4,589,408 | A | | 5/1986 | Singer |

(Continued)

FOREIGN PATENT DOCUMENTS

| | | |
|---|---|---|
| FR | 953456 | 12/1949 |
| FR | 1165524 | 10/1958 |

*Primary Examiner* — Katherine Moran
*Assistant Examiner* — Timothy K Trieu
(74) *Attorney, Agent, or Firm* — Christopher C. Dremann

(57) ABSTRACT

A transport hood for conveying a detainee protects conveying personnel from exposure to blood and body fluids of the detainee, while avoiding discomfort and potential breathing difficulty to the detainee caused by blood and body fluids retained within the transport hood. The transport hood includes a top portion positioned over the head of the detainee to below the eyes and above the nose of the detainee. A bottom portion is joined to the top portion by a first circumferential length of elastic and extends downwardly to below the chin of the detainee. A second length of elastic gathers the bottom portion around the neck of the detainee. The transport hood further includes a skirt attached at the first length of elastic that hangs loosely and extends downwardly to at least the neck of the detainee.

17 Claims, 3 Drawing Sheets

(56) References Cited

U.S. PATENT DOCUMENTS

| | | | | | |
|---|---|---|---|---|---|
| 4,698,853 | A | | 10/1987 | Walton | |
| 4,805,639 | A | | 2/1989 | Dial et al. | |
| 4,887,316 | A | | 12/1989 | Morandini | |
| 4,979,236 | A | | 12/1990 | Merrill et al. | |
| 5,146,622 | A | | 9/1992 | Blutstein | |
| 5,367,706 | A | * | 11/1994 | Davidson | 2/4 |
| 5,664,262 | A | * | 9/1997 | Cominsky | 2/202 |
| 5,708,982 | A | | 1/1998 | Armani | |
| 5,842,231 | A | | 12/1998 | Dawes | |
| 5,864,887 | A | | 2/1999 | Kozawa | |
| 6,131,203 | A | * | 10/2000 | Cominsky | 2/202 |
| 2004/0019957 | A1 | * | 2/2004 | Lewis et al. | 2/410 |
| 2005/0120452 | A1 | * | 6/2005 | Cominsky | 2/9 |
| 2009/0151049 | A1 | * | 6/2009 | Conrardy et al. | 2/206 |
| 2009/0151055 | A1 | * | 6/2009 | Duncan | 2/410 |
| 2009/0178176 | A1 | * | 7/2009 | Rowe et al. | 2/172 |

* cited by examiner

TRANSPORT HOOD INCLUDING SKIRT

FIELD OF THE INVENTION

The present invention relates to a protective head covering, and more particularly, to a transport hood for protecting conveying personnel from exposure to the blood and body fluids of a detainee. In exemplary embodiments, the invention is a transport hood including a top portion and a bottom portion made of an open mesh material, and a loose skirt made of a breathable fabric material.

BACKGROUND OF THE INVENTION

Each year, the number of detainees who are infected with the Human Immune Virus (HIV), Acquired Immune Deficiency Syndrome (AIDS) and other communicable diseases increases dramatically. The transportation of detainees, such as prisoners, invariably results in moments of high stress, duress and emotion. During these moments, the detainee may resist the conveying personnel, and thus become injured to the extent that the detainee bleeds from around the mouth and/or nose. In addition, the detainee may intentionally or accidently issue body fluids, such as spit or vomit, onto the conveying personnel as a weapon of last resort against restraint. Accordingly, personnel who convey detainees must take care to avoid contact with the detainee's blood and body fluids.

Protective head coverings, known as transport hoods, have long been utilized to constrain detainees, and to protect the conveying personnel from the detainee as well as to protect the detainee from the surrounding environment. However, prior transport hoods include a discrete opening adjacent the eyes of the detainee. Thus, conveying personnel are required to take additional time to orient the opening provided in the transport hood with the eyes of the detainee. The additional time that the conveying personnel are in close proximity to the detainee increases the risk that the conveying personnel may come in contact with the blood and/or body fluids of the detainee. Further, the discrete opening restricts the vision of the detainee and prevents the conveying personnel from observing the head of the detainee from all angles.

A protective head covering is disclosed in U.S. Pat. No. 1,186,703 to Sullivan. Sullivan discloses a protective head covering, or hood, for use by an operator of a baling press or threshing machine. The Sullivan hood shields the head, eyes, nose, mouth and neck of the operator from dust and small particles of debris, such as straw. However, the Sullivan hood includes a pair of discrete openings that must be oriented adjacent the eyes of the operator and is not intended to prevent bacteria, blood and body fluids of the operator from being projected into the surrounding environment.

U.S. Pat. No. 4,589,408 to Singer discloses a protective head covering for use as a surgical mask and hood. The Singer mask and hood protects the wearer from bacteria, blood and body fluids in the surrounding environment, and prevents bacteria, blood and body fluids issued by the wearer from being dispersed into the surrounding environment. However, the Singer mask and hood likewise includes a discrete opening that must be oriented with the eyes of the wearer, and does not permit the head of the wearer to be observed from any angle.

U.S. Pat. No. 5,664,262 to Cominsky discloses a transport hood for protecting conveying personnel from exposure to the body fluids of a detainee. The transport hood disclosed by the Cominsky '262 patent includes a top portion and a bottom portion each constructed of a different material. The top portion is substantially transparent. The bottom portion is made of a breathable plastic or fabric cloth which is impervious to blood and body fluids issued by the detainee. The top portion of the transport hood covers the head of the detainee to just below the eyes and the bottom portion covers the head of the detainee from just below the eyes to just below the chin. A first length of elastic joins the top portion to the bottom portion just below the eyes of the detainee to gather the top portion and hold the transport hood securely on the head of the detainee. A second length of elastic is provided on the lowermost edge of the bottom portion to secure the transport hood about the neck of the detainee.

U.S. Pat. No. 6,131,203 to Cominsky discloses a cinching grommet for use with the transport hood of the Cominsky '262 patent. The cinching grommet disclosed by the Cominsky '203 patent is a thin disk made of a flexible plastic material having at least one opening formed therethrough for receiving an excess amount of the material of the top portion of the transport hood. The cinching grommet grasps and secures the excess material of the top portion so that the transport hood is properly positioned on the head of the detainee with the lowermost edge of the top portion and the uppermost edge of the bottom portion just below the eyes of the detainee.

The transport hood taught by the aforementioned Cominsky patents has been well received by law enforcement agencies as being effective for protecting conveying personnel from exposure to the blood and body fluids of a detainee. In certain instances, however, the bottom portion of the transport hood being impervious to blood and body fluids could cause discomfort to the detainee. In particular, vomit ejected from the mouth of the detainee may accumulate within the bottom portion of the transport hood in the event that conveying personnel improperly position or improperly secure the transport hood onto the head of the detainee. If conveying personnel allow a substantial amount of vomit or spit to accumulate within the bottom portion of the transport hood, the detainee could experience difficulty breathing and potentially be rendered unconscious due to oxygen deprivation (hypoxia). Unless conveying personnel utilize the transport hood as intended and properly address the aforementioned situation, the detainee could potentially suffer a hypoxic brain injury and/or cardiac arrest.

As is now apparent, a transport hood for protecting conveying personnel from the blood and body fluids of a detainee is needed that not only prevents blood and body fluids issued by the detainee from being spread into the surrounding environment, but also protects the detainee from discomfort and potential breathing difficulty. The present invention, as described in detail herein, provides a transport hood that protects conveying personnel from the blood and body fluids of a detainee, while at the same time avoiding potential discomfort and breathing difficulty to the detainee that could result from blood or body fluids being retained within the transport hood.

SUMMARY OF THE INVENTION

The invention is a transport hood used to cover the head of a person who is being detained, referred to herein as a "detainee," such as a prisoner being held in custody by law enforcement personnel. Detainees are subject to carrying, and possibly spreading, bacteria, pathogens, and infectious and contagious diseases which are communicated through contact with blood or body fluids. The transport hood acts as a barrier between the blood and body fluids of the detainee and the surrounding environment to protect personnel who transport, or convey, the detainee while in custody. The transport hood also acts to avoid discomfort to the detainee and potential breathing difficulty that could result if blood or body fluids are retained within the transport hood.

A transport hood according to the invention includes a top portion and a bottom portion each constructed of a substantially transparent material, such as an open mesh plastic or fabric cloth separated by a first length of elastic. The top portion and the bottom portion may be formed as a single dome-shaped component, or alternatively as illustrated by the exemplary embodiments shown and described herein, separate components joined together at the first length of elastic. The transport hood further includes a skirt that is attached to the top portion and/or the bottom portion at the first length of elastic. The skirt is made of a breathable plastic or fabric cloth that is impervious to blood and body fluids issued by the detainee.

The top portion of the transport hood covers the head of the detainee to just below the eyes. The bottom portion of the transport hood covers the head of the detainee from just below the eyes to just below the chin. The top portion and the bottom portion are joined together by a first length of elastic at a lowermost edge of the top portion and an uppermost edge of the bottom portion. As a result, the top portion and the bottom portion are not easily separated (e.g. torn apart) under normal conditions of wear and use. The first length of elastic gathers the top and bottom portions of the transport hood together and is sufficiently elastic to hold the hood securely on the head of the detainee, without being painful or particularly restraining.

A second length of elastic is provided on the lowermost edge of the bottom portion of the transport hood. The second length of elastic is sufficiently elastic to allow the transport hood to be stretched easily over the head of the detainee, while securing the hood around the neck of the detainee without causing discomfort or restricting the breathing of the detainee.

The open mesh material of the top portion of the transport hood does not inhibit the detainee's vision. In addition, the open mesh material of the top portion permits conveying personnel to observe the head of the detainee from any angle. The open mesh material of the bottom portion and the breathable material of the skirt of the transport hood do not inhibit the detainee's breathing. In addition, the first length of elastic and the second length of elastic of the transport hood prevent the detainee from easily removing the transport hood with his or her arms restrained.

The impervious material of the skirt of the transport hood protects conveying personnel from exposure to the blood and body fluids of the detainee. Although the use of rubber gloves is now mandatory for most conveying personnel, gloves protect only the hands of the conveying personnel from exposure to the detainee's blood and body fluids. The impervious nature of the skirt of the transport hood prevents blood and body fluids that issue from the nose and mouth of the detainee from being communicated to the conveying personnel. Accordingly, the transport hood significantly reduces the risk that conveying personnel may be infected with communicable diseases, such as HIV and AIDS, spread through contact with the blood or body fluids of a detainee. If desired, the transport hood may be intended to be disposed after a single use to ensure that the blood or body fluids from one detainee are not spread to another detainee.

The transport hood of the present invention also avoids potential discomfort and/or breathing difficulty to the detainee as a result of blood and/or body fluids being retained within the transport hood. More particularly, the open mesh material of the bottom portion along with the skirt being attached to and extending downwardly from the first length of elastic without being attached to the second length of elastic prevents blood and/or body fluids, such as vomit, from being retained within the transport hood.

BRIEF DESCRIPTION OF THE DRAWINGS

Exemplary embodiments of the invention are illustrated in the accompany drawing figures, wherein like reference characters are used to identify the same or similar parts, components, features or elements of the invention in the various views.

DETAILED DESCRIPTION OF THE PREFERRED EMBODIMENT

Figure 1:
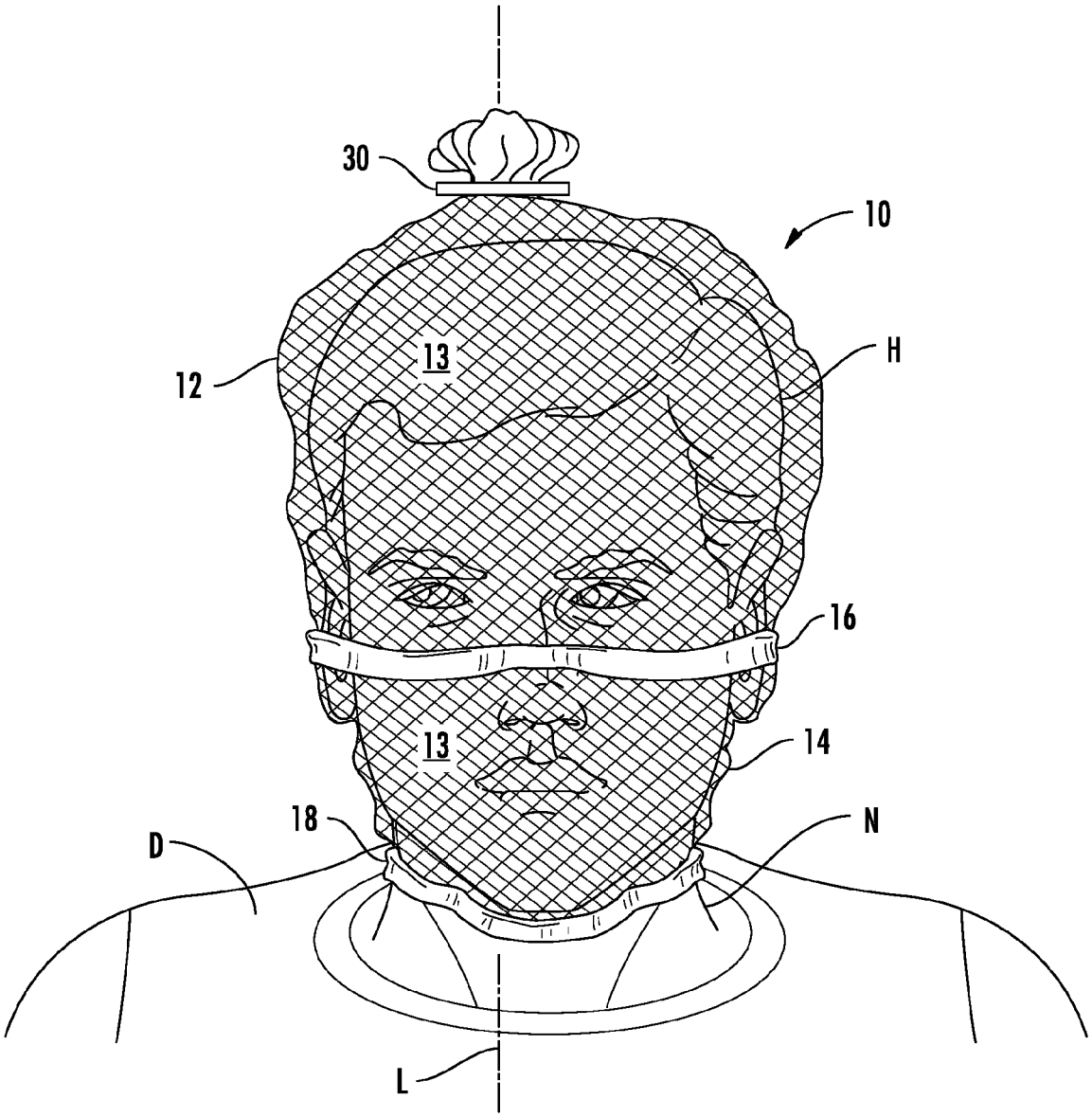
FIG. 1 is a front perspective view of an exemplary embodiment of a transport hood according to the invention showing the top portion and the bottom portion of the transport hood with the skirt removed for purposes of clarity.

Referring now more specifically to the drawing figures, FIG. 1 is a front perspective view of a protective head covering, referred to herein as a transport hood, 10 according to the invention shown with a portion of the transport hood removed for purposes of clarity. The transport hood 10 is generally dome-shaped, and thus, is substantially symmetric about a longitudinal axis L. The transport hood 10 comprises a top portion 12 and a bottom portion 14. If desired, the top portion 12 and the bottom portion 14 may be formed as a single dome-shaped component. Alternatively, the top portion 12 and the bottom portion 14 may be formed as separate components and joined together. As shown in FIG. 1, a lowermost edge of the top portion 12 is joined to an uppermost edge of the bottom portion 14 by a first length of an elastic material 16 that extends around the circumference of the transport hood 10. Also as shown in FIG. 1, a second length of elastic material 18 extends around the circumference of the transport hood 10 at the lowermost edge of the bottom portion 14. The transport hood 10 is configured to be placed over the head of a detainee D, such as a prisoner.

As shown, the top portion 12 of the transport hood 10 covers the head H of the detainee D from just below the eyes, for example at the bridge of the nose, upwards to the top of the head. In the exemplary embodiments shown and described herein the top portion 12 is made of a substantially transparent material, and more particularly, a plastic or fabric cloth open mesh 13. In a particularly advantageous embodiment, the top portion 12 is made of a fine mesh nylon material. The size of the openings provided in the mesh 13 are large enough to not inhibit the vision or the breathing of the detainee D, but are not large enough to interfere with the facial features (e.g., eyes, nose, ears, etc.) of the detainee or to allow the detainee to reposition the transport hood 10 with his or her arms restrained.

As shown, the bottom portion 14 covers the head H and a portion of the neck N of the detainee D from below the eyes, for example at the bridge of the nose, downwards to the neck. The bottom portion 14 is likewise made of a substantially transparent material, and more particularly, a plastic or fabric cloth open mesh 13. In a particularly advantageous embodiment, the bottom portion 14 is made of a fine mesh nylon material. The size of the openings provided in the mesh 13 are large enough to not inhibit the vision or the breathing of the detainee D, but are not large enough to interfere with the facial features (e.g., nose, mouth, etc.) of the detainee or to allow the detainee to reposition the transport hood 10 with his or her arms restrained.

The first length of elastic 16 is preferably sewn to the lowermost edge of the top portion 12 and to the uppermost edge of the bottom portion 14 so that the top and bottom portions are not easily torn apart under conditions of normal wear and use. The first length of elastic 16 gathers the top portion 12 of the transport hood 10 just below the eyes of the detainee D to retain the transport hood loosely on the head H of the detainee without being uncomfortable or unreasonably restraining. The second length of elastic 18 is preferably sewn to the lowermost edge 15 of the bottom portion 14 of the transport hood 10. The second length of elastic 18 may have substantially the same length as the first length of elastic 16, but preferably, has a shorter length and/or greater elasticity. Regardless, the second length of elastic 18 is long enough or elastic enough to allow the transport hood 10 to be easily stretched over the head of the detainee D and to subsequently secure the transport hood around the neck N of the detainee D without being uncomfortable or interfering with the ability of the detainee to breathe.

Figure 2:
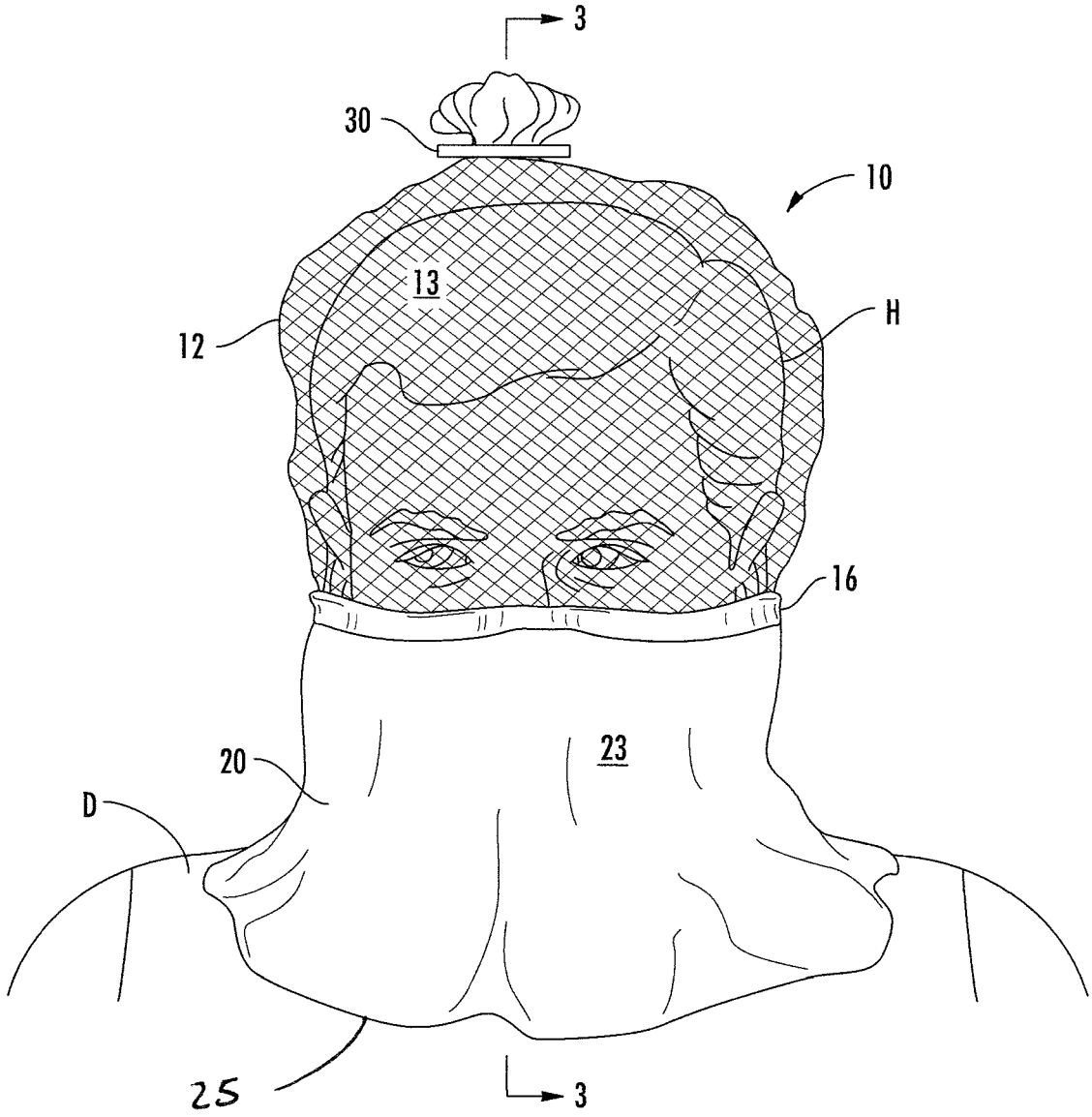
FIG. 2 is a front perspective view of the transport hood of FIG. 1 including the skirt.

FIG. 2 is a front perspective view of the transport hood 10 shown with a skirt 20 provided to protect conveying personnel, such as law enforcement personnel, from exposure to the blood and body fluids of the detainee D. The skirt 20 also avoids any potential discomfort and/or breathing difficulty experienced by the detainee D as a result of blood and/or body fluids of the detainee being retained within the transport hood 10. The skirt 20 is attached, for example sewn, to the top portion 12 and/or the bottom portion 14 at the first length of elastic 16. Alternatively, the skirt 20 may be attached only to the first length of elastic 16 separate from the top portion 12 and the bottom portion 14. Regardless, the skirt 20 is made of a breathable plastic or fabric cloth 23 that is impervious to bacteria borne by blood and body fluids that are issued by the detainee D. The impervious plastic or fabric cloth 23 of the skirt 20 is in contrast to the plastic or fabric cloth open mesh 13 of the top portion 12 and the bottom portion 14 that is not impervious to blood and body fluids of the detainee D. The skirt 20 may be made of a substantially transparent, translucent or opaque material. In a particularly advantageous embodiment, the skirt 20 is made of a substantially opaque polypropylene cloth 23 of the type commonly used in medical and surgical apparel that includes additional properties to provide an effective barrier against pathogens borne by blood and body fluids. Furthermore, the skirt 20 may comprise two or more layers made of the same or different materials. Regardless, the cloth 23 of the skirt 20 is breathable so that it does not significantly restrict or interfere with the ability of the detainee D to breathe normally.

Figure 3:
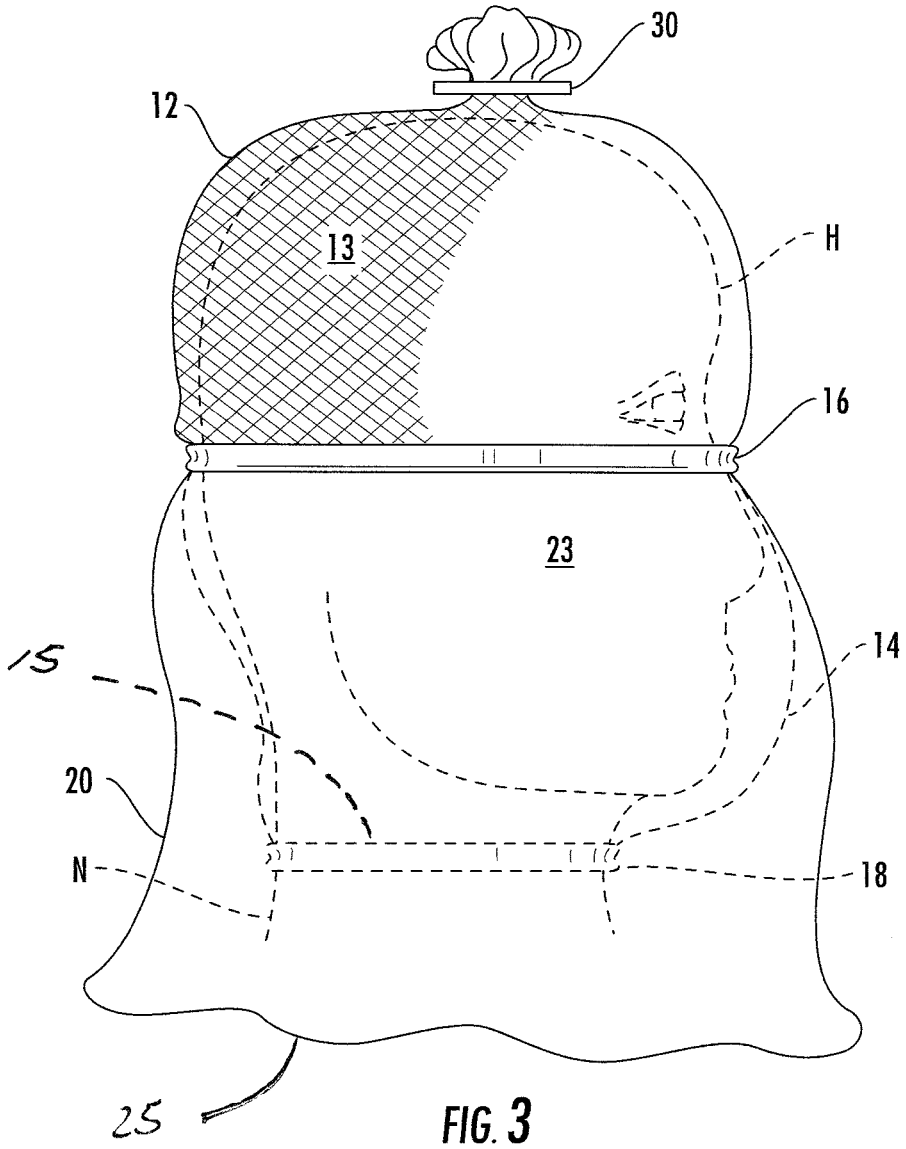
FIG. 3 is a sectional view of the transport hood of FIG. 2 taken along the line indicated by 3-3.

As best shown in the sectional view of FIG. 3, the skirt 20 hangs loosely from the first length of elastic 16 just below the eyes of the detainee D and downwards to about the neck N of the detainee. Importantly, the skirt 20 of the transport hood 10 is configured to cover at least the nose and the mouth of the detainee D, and thereby, the impervious nature of the material of the skirt protects conveying personnel from any blood and/or body fluids that may be expelled from the nose or the mouth of the detainee. At the same time, the skirt 23 is not secured around the neck N of the detainee D, and therefore, avoids the possibility that any blood and/or body fluids expelled from the nose or the mouth of the detainee D will be retained within the transport hood 10. In particular, the skirt 20 is configured to hang loosely about the neck N of the detainee D with the lowermost edge 25 of the skirt 20 not attached to the lowermost edge 15 of the bottom portion 14 so that vomit expelled from the mouth and/or nose of the detainee is unlikely to be retained within the transport hood 10 by the skirt, and thereby cause discomfort to the detainee and/or potential breathing difficulty. As a result, possible injury to the detainee D as a result of unconsciousness and/or hypoxia is avoided.

A transport hood 10 according to the present invention may also comprise an optional cinching grommet 30 of the type shown and described in the aforementioned Cominsky '203 patent issued to the same inventor. The cinching grommet 30 has an opening formed therethrough configured to receive an amount of the top portion 12 of the transport hood 10 sufficient to position the first length of elastic 16, and consequently, the uppermost edge of skirt 20 just below the eyes of the detainee D, for example at the bridge of the nose. The cinching grommet 30 gathers and secures the appropriate amount the top portion 12 of the transport hood 10 so that the skirt 20 is properly positioned for the particular size and shape of the head H of the detainee D with the transport hood secured thereon. In this manner the skirt 20 effectively protects conveying personnel from exposure to, or from contact with, blood and/or body fluids of the detainee D, while at the same time avoiding potential discomfort and/or breathing difficulty to the detainee.

Exemplary embodiments of a transport hood according to the present invention for protecting conveying personnel, while avoiding potential discomfort and breathing difficulty to a detainee have been shown and described herein. However, the scope of the present invention is not intended to be limited in any manner to the exemplary embodiments or by the description and/or illustration of the exemplary embodiments provided herein. Instead, the present invention, and in particular the appended claims, are intended to be given the broadest reasonable interpretation consistent with the written description and accompany drawing figures.

That which is claimed is:

1. A transport hood for covering a head of a detainee, comprising:

a top portion made of a material defining an open mesh that is substantially transparent, the top portion being configured to extend around the head of the detainee, the top portion having a lowermost edge;

a bottom portion made of a material defining an open mesh that is not impervious to blood and body fluids, the bottom portion being configured to extend around the head of the detainee, the bottom portion having an uppermost edge and a lowermost edge;

a first length of elastic disposed between the lowermost edge of the top portion and the uppermost edge of the bottom portion for gathering the top portion and the bottom portion together; and a skirt made of a breathable material that is impervious to blood and body fluids, the skirt being attached at the first length of elastic with the skirt extending downwardly from the first length of elastic and outwardly of the bottom portion such that the skirt hangs loosely from the first length of elastic and a lowermost edge of the skirt is not attached to the lowermost edge of the bottom portion.

2. A transport hood according to claim 1, wherein the material of the top portion is a fine mesh nylon.

3. A transport hood according to claim 1, wherein the material of the bottom portion is a fine mesh nylon.

4. A transport hood according to claim 1, wherein the breathable material that is impervious to blood and body fluids is a substantially opaque polypropylene cloth.

5. A transport hood according to claim 1, wherein the skirt comprises two or more layers of the breathable material that is impervious to blood and body fluids.

6. A transport hood according to claim 1, wherein the first length of elastic is attached to the lowermost edge of the top portion and to the uppermost edge of the bottom portion.

7. A transport hood according to claim 1, wherein the skirt is attached to at least one of the first length of elastic, the lowermost edge of the top portion, and the uppermost edge of the bottom portion.

8. A transport hood according to claim 1, further comprising a second length of elastic disposed at the lowermost edge of the bottom portion for gathering the lowermost edge of the bottom portion together.

9. A transport hood according to claim 8, wherein the second length of elastic is attached to the lowermost edge of the bottom portion.

10. A transport hood for covering a head of a detainee and for protecting conveying personnel from exposure to blood and body fluids of the detainee, while avoiding discomfort and potential breathing difficulty to the detainee as a result of blood and body fluids of the detainee being retained within the transport hood, the transport hood comprising:

a dome-shaped top portion made of a substantially transparent material and having a lowermost edge, the top portion being configured to be positioned over the head of the detainee;

a bottom portion having an uppermost edge joined to the lowermost edge of the top portion, the bottom portion being made of a material defining an open mesh that is not impervious to blood and body fluids, the bottom portion being configured to extend downwardly from the lowermost edge of the top portion to a lowermost edge of the bottom portion; and a skirt having an uppermost edge joined to at least one of the lowermost edge of the top portion and the uppermost edge of the bottom portion, the skirt being configured to extend downwardly from the at least one of the lowermost edge of the top portion and the uppermost edge of the bottom portion and outwardly of the bottom portion such that the skirt hangs loosely and is not attached to the lowermost edge of the bottom portion.

11. A transport hood according to claim 10, wherein the top portion is made of a material defining an open mesh.

12. A transport hood according to claim 10, wherein the skirt is made of a breathable material that is impervious to blood and body fluids.

13. A transport hood according to claim 12, wherein the breathable material is a substantially opaque polypropylene cloth.

14. A transport hood according to claim 10, further comprising a first length of elastic disposed between the lowermost edge of the top portion and the uppermost edge of the bottom portion for gathering the top portion and the bottom portion together.

15. A transport hood according to claim 14, further comprising a second length of elastic disposed at the lowermost edge of the bottom portion for gathering the bottom portion together.

16. A transport hood according to claim 15, wherein the first length of elastic secures the top portion of the transport hood on the head of the detainee and the second length of elastic secures the bottom portion of the transport hood on the head of the detainee.

17. A transport hood according to claim 10, further comprising a cinching grommet having an opening formed therethrough for receiving and securing an amount of the top portion sufficient to position the transport hood on the head of the detainee.

* * * * *